US009222049B2

(12) United States Patent
Dunning et al.

(10) Patent No.: US 9,222,049 B2
(45) Date of Patent: Dec. 29, 2015

(54) LUBRICATING COMPOSITION

(75) Inventors: Simon William Dunning, Chester (GB); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 393 days.

(21) Appl. No.: 13/378,511

(22) PCT Filed: Jun. 23, 2010

(86) PCT No.: PCT/EP2010/058920

§ 371 (c)(1),
(2), (4) Date: Feb. 7, 2012

(87) PCT Pub. No.: WO2010/149706

PCT Pub. Date: Dec. 29, 2010

(65) Prior Publication Data

US 2012/0129741 A1 May 24, 2012

Related U.S. Application Data

(60) Provisional application No. 61/220,009, filed on Jun. 24, 2009.

(30) Foreign Application Priority Data

Jun. 24, 2009 (EP) ..... 09163626

(51) Int. Cl.

| | |
|---|---|
| ***C10M 169/04*** | (2006.01) |
| ***C10M 159/00*** | (2006.01) |
| ***C10M 165/00*** | (2006.01) |
| ***C10M 107/02*** | (2006.01) |
| ***C10M 111/04*** | (2006.01) |

(52) U.S. Cl.

CPC ..... *C10M 107/02* (2013.01); *C10M 111/04* (2013.01); *C10M 2203/1006* (2013.01); *C10M 2205/024* (2013.01); *C10M 2205/173* (2013.01); *C10M 2209/084* (2013.01); *C10N 2220/022* (2013.01); *C10N 2220/025* (2013.01); *C10N 2230/02* (2013.01); *C10N 2230/06* (2013.01); *C10N 2230/54* (2013.01); *C10N 2230/74* (2013.01); *C10N 2240/10* (2013.01); *C10N 2240/102* (2013.01)

(58) Field of Classification Search

CPC ..... C10M 171/02
USPC ..... 508/110
See application file for complete search history.

(56) References Cited

U.S. PATENT DOCUMENTS

| | | | | |
|---|---|---|---|---|
| 7,141,157 | B2 | 11/2006 | Rosenbaum et al. | |
| 7,476,645 | B2 | 1/2009 | Rosenbaum et al. | |
| 2004/0045868 | A1 | 3/2004 | Germaine et al. | |
| 2006/0196807 | A1 | 9/2006 | Rosenbaum et al. | |
| 2006/0199743 | A1 | 9/2006 | Rosenbaum et al. | 508/110 |
| 2007/0197406 | A1 | 8/2007 | Locke et al. | |
| 2007/0232506 | A1 | 10/2007 | Gao et al. | 508/485 |
| 2008/0149529 | A1 | 6/2008 | Rosenbaum et al. | 208/19 |
| 2008/0248981 | A1 * | 10/2008 | Matsui et al. | 508/382 |
| 2009/0082235 | A1 | 3/2009 | Hilker et al. | |
| 2009/0312205 | A1 | 12/2009 | Colbourne et al. | |

FOREIGN PATENT DOCUMENTS

| | | | |
|---|---|---|---|
| EP | 0668342 | 8/1995 | C10G 65/04 |
| EP | 0776959 | 6/1997 | C10G 65/04 |
| EP | 1029029 | 4/1999 | C10M 143/08 |
| EP | 1058720 | 9/1999 | C10M 141/10 |
| EP | 1688476 | 8/2006 | C10M 111/04 |
| JP | 2008024845 | 2/2008 | |
| JP | 2008274237 | 11/2008 | |
| JP | 2008274238 | 11/2008 | |
| WO | WO9721788 | 6/1977 | C10G 67/04 |
| WO | WO9826030 | 6/1998 | C10M 159/18 |
| WO | WO9941332 | 8/1999 | C10G 69/02 |
| WO | WO0008115 | 2/2000 | C10G 45/58 |
| WO | WO0014179 | 3/2000 | C10G 2/00 |
| WO | WO0014183 | 3/2000 | C10G 45/58 |
| WO | WO0014187 | 3/2000 | |
| WO | WO0015736 | 3/2000 | C10G 65/00 |
| WO | WO0118156 | 3/2001 | C10M 101/02 |
| WO | WO0157166 | 8/2001 | C10M 171/02 |
| WO | WO02064711 | 8/2002 | C10M 169/04 |
| WO | 02070629 | 9/2002 | |
| WO | WO02070631 | 9/2002 | C10G 65/16 |
| WO | WO2004081157 | 9/2004 | C10M 171/02 |
| WO | WO2006094264 | 9/2006 | |
| WO | WO2007045629 | 4/2007 | C10M 169/04 |
| WO | WO2007107506 | 9/2007 | C10M 169/04 |

OTHER PUBLICATIONS

DeGroote, Y.; "How Low Can You Go—A OW Engine Oil for IVECO Trucks"; Lubes'n'Greases (Europe-Middle East-Africa), Jul./Aug. 2008, No. 8, pp. 18-22.

Kirk-Othmer Encyclopedia of Chemical Technology; "Lubrication and Lubricants"; 3rd Edition; vol. 14, pp. 477-526, 1978.

* cited by examiner

*Primary Examiner* — James Goloboy
*Assistant Examiner* — Francis C Campanell

(57) ABSTRACT

The present invention provides a lubricating composition for use in the crankcase of an engine comprising a base oil and one or more additives, wherein the base oil comprises a Fischer-Tropsch derived base oil and wherein the lubricating composition has a kinematic viscosity at 100 C (according to ASTM D 445} of below 5.6 cSt and a Noack volatility (according to ASTM D 5800) of below 15 wt. %.

19 Claims, No Drawings

LUBRICATING COMPOSITION

PRIORITY CLAIM

The present application is a national stage application of International Application PCT/EP2010/058920, filed 23 Jun. 2010, which claims priority from European Application 09163626.6 filed 24 Jun. 2009 and U.S. provisional application Ser. No. 61/220,009, filed 24 Jun. 2009, both of which are incorporated by reference.

FIELD OF THE INVENTION

Background of the Invention

The present invention relates to a lubricating composition comprising a base oil and one or more additives for particular use in the crankcase of an engine, in particular a heavy duty diesel engine.

Fuel economy is becoming a priority in the auto industry. As is explained in the article "How Low Can You Go—A 0W Engine Oil for Iveco Trucks", Y. De Groote, Lubes'n'Greases (Europe-Middle East-Africa), July/August 2008, Number 8, pages 18-22, most passenger cars ran on SAE 10W-30 or 10W-40 oils in the past, but SAE 5W-30 and 5W-20 products were introduced in recent years and are gaining popularity. In the trucking industry SAE 15W-40 oils were most popular and they continue to be the dominant grade in view of fear that thinner oils would compromise anti-wear protection of the engine. Nevertheless, the possibility of using SAE 0W oils in heavy-duty trucks is being investigated.

However, it is problematic to formulate engine oils (including a.o. passenger car motor oils and heavy-duty diesel engine oils) with mineral base oils in order to meet the thinner (such as SAE 0W-x) grades of the so-called SAE J300 Specifications (as revised in May 2004). SAE stands for Society of Automotive Engineers.

A further problem of known mineral base oil based engine oils is that they may have undesirable properties for one or more of fuel economy, wear performance and Noack volatility when used in relatively thin engine oils.

Furthermore, although it is possible—as suggested by the above article in Lubes'n'Greases—to formulate certain 0W engine oils using Group IV base oils (PAOs; poly-alpha olefin base oils), a disadvantage of using such PAOs is the high cost of manufacture thereof and issues with shortage of supply.

WO 2006/094264 discloses in its Example 2a 0W-20 lubricating composition containing 73.36 wt. % Fischer-Tropsch derived base oil, 15.99 wt. % of a PAO base oil (Durasyn® 174 PAO-40), 10.35 wt. % of a Detergent-Inhibitor additive package and 0.3 wt. % of a pour point depressant. The lubricating composition according to WO 2006/094264 has a kinematic viscosity at 100° C. of 7.093 cSt.

US 2008/0149529 discloses a process for making a base oil blend and the base oil blend itself (i.e. not a fully formulated lubricating formulation for use in the crankcase of an engine).

WO 2007/107506 discloses in Example 1a shock absorber fluid containing 96.83 wt. % of a Fischer-Tropsch derived base oil (having a kinematic viscosity at 100° C. of 2.4 cSt), 0.20 wt. % of an anti-oxidant, 2.30 wt. % of a viscosity improver, 0.37 wt. % of a corrosion inhibitor and 0.3 wt. % of a colouring agent. Shock absorber fluids typically have relatively high volatility values when compared with engine oils (exemplified by e.g. the less severe Noack evaporation test DIN 51581 as mentioned in Table 3 of WO 2007/107506 when compared with the ASTM D 5800 test as used according to the present invention).

EP 1 688 476 discloses in Example 2a lubricating composition containing 90 wt. % of a Fischer-Tropsch derived base oil, the composition having a kinematic viscosity at 100° C. of 8.1 cSt.

SUMMARY OF THE INVENTION

It is an object of the present invention to minimize one or more of the above problems.

It is another object of the present invention to provide alternative relatively thin lubricating compositions for use in the crankcase of an engine, the compositions having simultaneously desirable properties for fuel economy, wear performance and Noack volatility.

One or more of the above or other objects can be obtained by the present invention by providing a lubricating composition for use in the crankcase of an engine comprising a base oil and one or more additives, wherein the base oil comprises a Fischer-Tropsch derived base oil and wherein the lubricating composition has a kinematic viscosity at 100° C. (according to ASTM D 445) of below 5.6 cSt and a Noack volatility (according to ASTM D 5800) of below 15 wt. %.

DETAILED DESCRIPTION OF THE INVENTION

It has now surprisingly been found according to the present invention that suitable thin engine oil compositions (including those meeting 0W specifications according to SAE J300 Specifications) can be formulated based on Fischer-Tropsch derived base oils, which compositions exhibit desirable wear performance and Noack volatility properties.

Another advantage of the present invention is that the above desirable properties can be achieved for a top-tier heavy duty diesel engine lubricant or a top-tier Passenger Car Motor Oil (PCMO) lubricant as well. A characteristic of such top-tier engine lubricants is that they require a relatively high treat of a performance additive package (such as above 9 wt. %). Such a performance additive package thickens the overall finished lubricant, which consequently means that a lower viscosity contribution is left for the base oil to meet the same viscosity requirements. A consequence of using a lower viscosity base oil is that it becomes difficult to meet the (Noack) volatility values according to industry specifications. However, it has been surprisingly found according to the present invention that desirable (Noack) volatility values can be achieved.

It is noted that WO 02/064711 discloses the use of Fischer-Tropsch derived base oils in 0W-x compositions. However, contrary to the present invention, WO 02/064711 relates to lubricating compositions having a kinematic viscosity at 100° C. (according to ASTM D 445) of above 5.6 cSt.

Also, WO 2004/081157 discloses 0W engine oil formulations containing Fischer-Tropsch derived base oils. However, also WO 2004/081157 does not disclose lubricating compositions having a kinematic viscosity at 100° C. (according to ASTM D 445) of below 5.6 cSt.

There are no particular limitations regarding the base oil used in lubricating composition according to the present invention (provided that the base oil comprises at least a Fischer-Tropsch derived base oil and provided that the requirements in respect of the lubricant composition according to the present invention are met), and various conventional mineral oils, synthetic oils as well as naturally derived esters such as vegetable oils may be conveniently used.

The base oil used in the present invention may—in addition to the Fischer-Tropsch derived base oil—conveniently comprise mixtures of one or more mineral oils and/or one or more synthetic oils; thus, according to the present invention, the term "base oil" may refer to a mixture containing more than one base oil, including at least one Fischer-Tropsch derived base oil. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Suitable base oils for use in the lubricating oil composition of the present invention are Group I-III mineral base oils (preferably Group III), Group IV poly-alpha olefins (PAOs), Group II-III Fischer-Tropsch derived base oils (preferably Group III) and mixtures thereof.

By "Group I", "Group II" "Group III" and "Group IV" base oils in the present invention are meant lubricating oil base oils according to the definitions of American Petroleum Institute (API) for categories I, II, III and IV. These API categories are defined in API Publication 1509, 15th Edition, Appendix E, April 2002.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the lubricating composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Synthetic oils include hydrocarbon oils such as olefin oligomers (including polyalphaolefin base oils; PAOs), dibasic acid esters, polyol esters, polyalkylene glycols (PAGs), alkyl naphthalenes and dewaxed waxy isomerates. Synthetic hydrocarbon base oils sold by the Shell Group under the designation "Shell XHVI" (trade mark) may be conveniently used.

Poly-alpha olefin base oils (PAOs) and their manufacture are well known in the art. Preferred poly-alpha olefin base oils that may be used in the lubricating compositions of the present invention may be derived from linear $O_2$ to $O_{32}$, preferably $C_6$ to $C_{16}$, alpha olefins. Particularly preferred feedstocks for said poly-alpha olefins are 1-octene, 1-decene, 1-dodecene and 1-tetradecene.

There is a strong preference for using a Fischer-Tropsch derived base oil over a PAO base oil, in view of the high cost of manufacture of the PAOs. Thus, preferably, the base oil contains more than 50 wt. %, preferably more than 60 wt. %, more preferably more than 70 wt. %, even more preferably more than 80 wt. %. most preferably more than 90 wt. % Fischer-Tropsch derived base oil. In an especially preferred embodiment not more than 5 wt. %, preferably not more than 2 wt. %, of the base oil is not a Fischer-Tropsch derived base oil. It is even more preferred that 100 wt % of the base oil is based on one or more Fischer-Tropsch derived base oils.

The total amount of base oil incorporated in the lubricating composition of the present invention is preferably present in an amount in the range of from 60 to 99 wt. %, more preferably in an amount in the range of from 65 to 90 wt. % and most preferably in an amount in the range of from 70 to 85 wt. %, with respect to the total weight of the lubricating composition.

Typically the base oil (or base oil blend) as used according to the present invention has a kinematic viscosity at 100° C. (according to ASTM D445) of above 3.0 cSt and below 5.6 cSt. According to a preferred embodiment of the present invention the base oil has a kinematic viscosity at 100° C. (according to ASTM D445) of between 3.5 and 4.5 cSt. In the event the base oil contains a blend of two or more base oils, it is preferred that the blend has a kinematic viscosity at 100° C. of between 3.5 and 4.5 cSt.

Preferably, the dynamic viscosity at −35° C. (according to ASTM D 5293) of the composition according to the present invention is below 6200 cP (1 cP is the same as 1 mPa·s), preferably below 5500 cP, more preferably 5000 cP, even more preferably below 4500 cP, or even as low as below 4000 cP or below 3500 cP. Typically, the dynamic viscosity at −35° C. is above 2000 cP.

Preferably, the high temperature, high shear viscosity ("HTHS"; according to ASTM D 4683) of the composition according to the present invention is below 2.6 cP, preferably below 2.0 cP, more preferably below 1.9 cP. Typically, the HTHS is above 1.5 cP.

The lubricating composition according to the present invention has a Noack volatility (according to ASTM D 5800) of below 15 wt. %. Typically, the Noack volatility (according to ASTM D 5800) of the composition is between 1 and 15 wt. %, preferably below 14.6 wt. % and more preferably below 14.0 wt. %.

Also it is preferred that the composition has a mini rotary viscometer (MRV) value at −40° C. (according to ASTM D 4684) of below 60,000 cP, more preferably below 20,000 cP, even more preferably below 7,000 cP, and typically above 4,000 cP.

The lubricating composition according to the present invention further comprises one or more additives such as anti-oxidants, anti-wear additives, dispersants, detergents, overbased detergents, extreme pressure additives, friction modifiers, viscosity index improvers, pour point depressants, metal passivators, corrosion inhibitors, demulsifiers, anti-foam agents, seal compatibility agents and additive diluent base oils, etc.

As the person skilled in the art is familiar with the above and other additives, these are not further discussed here in detail. Specific examples of such additives are described in for example Kirk-Othmer Encyclopedia of Chemical Technology, third edition, volume 14, pages 477-526.

Anti-oxidants that may be conveniently used include phenyl-naphthylamines (such as "IRGANOX L-06" available from Ciba Specialty Chemicals) and diphenylamines (such as "IRGANOX L-57" available from Ciba Specialty Chemicals) as e.g. disclosed in WO 2007/045629 and EP 1 058 720 B1, phenolic anti-oxidants, etc. The teaching of WO 2007/045629 and EP 1 058 720 B1 is hereby incorporated by reference.

Anti-wear additives that may be conveniently used include zinc-containing compounds such as zinc dithiophosphate compounds selected from zinc dialkyl-, diaryl- and/or alkylaryl-dithiophosphates, molybdenum-containing compounds, boron-containing compounds and ashless anti-wear additives such as substituted or unsubstituted thiophosphoric acids, and salts thereof.

Examples of such molybdenum-containing compounds may conveniently include molybdenum dithiocarbamates, trinuclear molybdenum compounds, for example as described in WO 98/26030, sulphides of molybdenum and molybdenum dithiophosphate.

Boron-containing compounds that may be conveniently used include borate esters, borated fatty amines, borated epoxides, alkali metal (or mixed alkali metal or alkaline earth metal) borates and borated overbased metal salts.

The dispersant used is preferably an ashless dispersant. Suitable examples of ashless dispersants are polybutylene succinimide polyamines and Mannich base type dispersants.

The detergent used is preferably an overbased detergent or detergent mixture containing e.g. salicylate, sulphonate and/or phenate-type detergents.

Examples of viscosity index improvers which may conveniently be used in the lubricating composition of the present invention include the styrene-butadiene stellate copolymers, styrene-isoprene stellate copolymers and the polymethacrylate copolymer and ethylene-propylene copolymers (also known as olefin copolymers) of the crystalline and non-crystalline type. Dispersant-viscosity index improvers may be used in the lubricating composition of the present invention. However, preferably the composition according to the present invention contains less than 1.0 wt. %, preferably less than 0.5 wt. %, of a Viscosity Index improver concentrate (i.e. VI improver plus "carrier oil" or "diluent"), based on the total weight of the composition. Most preferably, the composition is free of Viscosity Index improver concentrate. The term "Viscosity Modifier" as used hereafter (such as in Table 2) is meant to be the same as the above-mentioned term "Viscosity Index improver concentrate".

Preferably, the composition contains at least 0.1 wt. % of a pour point depressant. As an example, alkylated naphthalene and phenolic polymers, polymethacrylates, maleate/fumarate copolymer esters may be conveniently used as effective pour point depressants. Preferably not more than 0.3 wt. % of the pour point depressant is used.

Furthermore, compounds such as alkenyl succinic acid or ester moieties thereof, benzotriazole-based compounds and thiodiazole-based compounds may be conveniently used in the lubricating composition of the present invention as corrosion inhibitors.

Compounds such as polysiloxanes, dimethyl polycyclohexane and polyacrylates may be conveniently used in the lubricating composition of the present invention as defoaming agents.

Compounds which may be conveniently used in the lubricating composition of the present invention as seal fix or seal compatibility agents include, for example, commercially available aromatic esters.

The lubricating compositions of the present invention may be conveniently prepared by admixing the one or more additives with the base oil(s).

The above-mentioned additives are typically present in an amount in the range of from 0.01 to 35.0 wt. %, based on the total weight of the lubricating composition, preferably in an amount in the range of from 0.05 to 25.0 wt. %, more preferably from 1.0 to 20.0 wt. %, based on the total weight of the lubricating composition.

Preferably, the composition contains at least 9.0 wt. %, preferably at least 10.0 wt. %, more preferably at least 11.0 wt % of an additive package comprising an anti-wear additive, a metal detergent, an ashless dispersant and an anti-oxidant.

The lubricating compositions according to the present invention may be so-called "low SAPS" (SAPS=sulphated ash, phosphorus and sulphur), "mid SAPS" or "regular SAPS" formulations.

For Passenger Car Motor Oil (PCMO) engine oils the above ranges mean:

- a sulphated ash content (according to ASTM D 874) of up to 0.5 wt. %, up to 0.8 wt. % and up to 1.5 wt. %, respectively;
- a phosphorus content (according to ASTM D 5185) of up to 0.05 wt. %, up to 0.08 wt. % and typically up to 0.1 wt. %, respectively; and
- a sulphur content (according to ASTM D 5185) of up to 0.2 wt. %, up to 0.3 wt. % and typically up to 0.5 wt. %, respectively.

For Heavy Duty Diesel Engine Oils the above ranges mean:

- a sulphated ash content (according to ASTM D 874) of up to 1 wt. %, up to 1 wt. % and up to 2 wt. %, respectively;
- a phosphorus content (according to ASTM D 5185) of up to 0.08 wt. % (low SAPS) and up to 0.12 wt. % (mid SAPS), respectively; and
- a sulphur content (according to ASTM D 5185) of up to 0.3 wt. % (low SAPS) and up to 0.4 wt. % (mid SAPS), respectively.

In another aspect, the present invention provides the use of a lubricating composition according to the present invention as an engine oil in the crankcase of an engine, in order to improve fuel economy properties whilst maintaining desirable wear performance and Noack volatility properties. The engine oil may include a heavy duty diesel engine oil, a passenger car motor engine oil, as well as other types of engine oils.

The present invention is described below with reference to the following Examples, which are not intended to limit the scope of the present invention in any way.

EXAMPLES

Lubricating Oil Compositions

Various engine oils for use in a crankcase engine were formulated.

Table 1 indicates the properties for the base oils used. Table 2 indicates the composition and properties of the fully formulated engine oil formulations that were tested; the amounts of the components are given in wt. %, based on the total weight of the fully formulated formulations.

"Base oil 1" and "Base oil 2" were both similar Fischer-Tropsch derived base oils ("GTL 4") having a kinematic viscosity at 100° C. (ASTM D445) of approx. 4 cSt ($mm^2s^{-1}$). These GTL 4 base oils may be conveniently manufactured by the process described in e.g. WO 02/070631, the teaching of which is hereby incorporated by reference.

"Base oil 3" was a commercially available Group II base oil having a kinematic viscosity at 100° C. (ASTM D445) of 3.11 cSt. Base oil 3 is commercially available from e.g. SK Energy (Ulsan, South Korea) (under the trade designation "Yubase 3").

"Base oil 4" was a commercially available Group III base oil having a kinematic viscosity at 100° C. (ASTM D445) of approx. 4.34 cSt. Base oil 4 is commercially available from e.g. SK Energy (Ulsan, South Korea) (under the trade designation "Yubase 4").

"Base oil 5" was a commercially available Group III base oil having a kinematic viscosity at 100° C. (ASTM D445) of 4.11 cSt. Base oil 5 is commercially available from e.g. SK Energy (under the trade designation "Yubase 4+").

All tested engine oil formulations contained a combination of a base oil, an additive package and optionally a viscosity modifier, which additive package was the same in all tested compositions.

The additive package was a so-called "mid SAPS" (medium sulphated ash, phosphorus and sulphur) formulation.

The additive package contained a combination of additives including anti-oxidants, a zinc-based anti-wear additives, an ashless dispersant, an overbased detergent mixture and about 10 ppm of an anti-foaming agent.

The pour point depressant was a conventional polymethacrylate pour point depressant, commercially available from Infineum Additives (Abingdon, United Kingdom) under the trade designation "Infineum 351".

The viscosity modifier was a conventional styrene-hydrogenated isoprene co-polymer viscosity modifier concentrate, commercially available from Infineum Additives (Abingdon, United Kingdom) under the trade designation "Infineum SV 151".

The compositions of Example 1 and Comparative Example 1 were obtained by mixing the base oils with the additive package, pour point depressant and—if present—the viscosity modifier concentrate, using conventional lubricant blending procedures.

TABLE 1

| | Base oil 1 (GTL 4) | Base oil 2 (GTL 4) | Base oil 3 (Yubase 3) | Base oil 4 (Yubase 4) | Base oil 5 (Yubase 4+) |
|---|---|---|---|---|---|
| Kinematic viscosity at 40° C.[1] [cSt] | 16.52 | 15.77 | 12.35 | 20.24 | 17.95 |

TABLE 1-continued

| | Base oil 1 (GTL 4) | Base oil 2 (GTL 4) | Base oil 3 (Yubase 3) | Base oil 4 (Yubase 4) | Base oil 5 (Yubase 4+) |
|---|---|---|---|---|---|
| Kinematic viscosity at 100° C.[1] [cSt] | 3.88 | 3.75 | 3.11 | 4.34 | 4.11 |
| VI Index[2] | 131 | 129 | 113 | 124 | 133 |
| Pour point[3] [° C.] | −30 | −33 | −24 | −15 | −21 |
| Noack volatility[4] [wt. %] | 14 | 15 | 40.1 | 14.5 | 13.4 |
| Saturates[5] [wt. %] | 99.3 | 99.2 | 99.7 | 99.2 | 99.3 |

[1]According to ASTM D 445
[2]According to ASTM D 2270
[3]According to ASTM D 5950
[4]According to CEC L-40-A-93/ASTM D 5800
[5]According to IP 368 (Modified: pentane instead of hexane was used as a solvent; a higher sample load (4 g diluted to 25 ml instead of 2 g) was used; rotary evaporation (in 100 ml round bottomed flasks) was used to remove the solvent)

TABLE 2

| Component [wt. %] | Example 1 | Example 2 | Comp. Ex. 1 | Comp. Ex. 2 | Comp. Ex. 3 | Comp. Ex. 4 |
|---|---|---|---|---|---|---|
| Base oil 1 (GTL 4) | 89.8 | — | — | — | — | — |
| Base oil 2 (GTL 4) | — | 87.3 | — | — | — | — |
| Base oil 3 (Group II) | — | — | — | — | 40.6 | 40.4 |
| Base oil 4 (Group III) | — | — | 87.3 | — | 46.7 | 46.4 |
| Base oil 5 (Group III) | — | — | — | 87.3 | — | — |
| Additive package | 10 | 12.5 | 12.5 | 12.5 | 12.5 | 12.5 |
| Pour point depressant | 0.2 | 0.2 | 0.2 | 0.2 | 0.2 | 0.2 |
| Viscosity Modifier | — | — | — | — | — | 0.5 |
| TOTAL | 100 | 100 | 100 | 100 | 100 | 100 |
| Properties of the total composition | | | | | | |
| Kinematic viscosity at 100° C.[1] [cSt] | 5.15 | 5.40 | 6.31 | 5.89 | 5.47 | 5.55 |
| Dynamic viscosity at −35° C.[2] [cP] | 2747 | 2907 | 6605 | 4091 | 4259 | 4323 |
| HTHS[3] [cP] | 1.75 | 1.84 | 2.20 | 2.02 | 1.92 | 1.98 |
| Noack volatility[4] [wt. %] | 13.4 | 14.5 | 13.3 | 14.0 | 23.4 | 25.6 |
| MRV (mini rotary viscosity) at −40° C.[5] | n.d. | 5417 | n.d. | 10538 | n.d. | 10526 |

[1]According to ASTM D 445
[2]According to ASTM D 5293. NB 1 cP (centiPoise) = 1 mPa · s (milliPascal · second)
[3]According to ASTM D 4683
[4]According to ASTM D 5800
[5]According to ASTM D 4684
n.d. = not determined Wear Performance In order to demonstrate the wear properties of the present invention, wear measurements were performed according to the industry standard 4-ball wear test of ASTM D 4172 (time: 60 min; speed: 1500 rpm; temp: 75° C.) The measured wear scars according to ASTM D 4172 are indicated in Table 3 below; these values are seen as a good indicator of relative wear performance in the field of engine oils; a wear scar of less than 1.0 mm at a load of 60 kg is seen as desirable).

TABLE 3

| | Example 1 | Example 2 | Comp. Ex. 1 | Comp. Ex. 3 | Comp. Ex. 4 |
|---|---|---|---|---|---|
| Wear scar diameter at load of 60 kg [mm] | 0.72 | 0.70 | 0.73 | 0.73 | 0.69 |

Discussion

Example 1 exemplifies a finished lubricant containing a performance additive package treat of 10 wt. %, the lubricant meeting all viscometric and volatility criteria for an SAE 0W-XX lubricant, but having a kinematic viscosity of less than 5.6 cSt at 100° C. Example 1 has wear performance in sliding contacts no worse than a mineral Group III version (see Comparative Examples) with higher kinematic viscosity at 100° C.

Example 2 exemplifies a finished lubricant containing a performance additive package treat of 12.5 wt. %, the lubricant meeting all viscometric and volatility criteria for an SAE 0W-XX lubricant, but again having a kinematic viscosity of less than 5.6 cSt at 100° C. Example 2 has wear performance in sliding contacts no worse than a mineral Group III version (see Comparative Examples) with higher kinematic viscosity at 100° C.

Comparative Example 1 demonstrates that it is difficult (if not impossible) to make a finished lubricant using only mineral derived Group III base oil and a performance additive package treat of 12.5 wt. %, if the lubricant is to meet low temperature viscometric criteria of an SAE 0W-XX lubricant and a kinematic viscosity of less than 5.6 cSt at 100° C.

Comparative Example 2 demonstrates that it is difficult (if not impossible) to make a finished lubricant using only mineral derived Group III base oil and a performance additive package treat of 12.5 wt. %, if the lubricant is to meet viscometric criteria for an SAE 0W-XX lubricant and a kinematic viscosity of less than 5.6 cSt at 100° C. This lubricant according to Comparative Example 2 is in fact an SAE 0W-20 lubricant.

Comparative Example 3 and 4 demonstrate that it is difficult (if not impossible) to make a finished lubricant using only mineral derived Group II and Group III base oils and a performance additive package treat of 12.5 wt. %, if the finished lubricant is to meet the viscometric criteria for an SAE 0W-XX lubricant, to have a kinematic viscosity of less than 5.6 cSt at 100° C., and to meet the current industry standard (American Petroleum Institute) for volatility of less than 15 wt. % loss.

Thus, as can be learned from the above and Table 2, the present invention surprisingly allows to formulate lubricating compositions having a kinematic viscosity at 100° C. (according to ASTM D 445) of below 5.6 cSt. As acknowledged in the field (see also the Article in Lubes'n'Greases cited above), the use of thinner lubricating compositions (and a kinematic viscosity at 100° C. below 5.6 cSt is deemed relatively thin) results in improved fuel economy.

The present invention even allows formulating lubricating compositions exceeding (in terms of kinematic viscosity at 100° C. and dynamic viscosity at −35° C.) the SAE 0W-20 specification (according to the SAE J300 Specifications as revised in May 2004) whilst retaining the ability to include premium top-tier rates of performance additive packages of 12.5 wt. % while maintaining control of volatility. Table 3 shows that the lubricating compositions according to the present invention also show desirable anti-wear properties.

Table 2 further shows that if only mineral derived base oils are used for meeting a kinematic viscosity at 100° C. of below 5.6 cSt, this results in an undesirably high Noack volatility.

Thus, an important advantage of the present invention is that fuel economy improving 0W formulations, or even thinner, can be obtained that meet stringent Noack volatility requirements (less than 15 or even less than 14 wt. %), whilst maintaining desirable anti-wear properties, especially when compared with formulations containing only mineral derived base oils.

We claim:

1. A lubricating composition comprising:

a base oil and one or more additives, wherein the base oil comprises more than 80 wt. % of a Fischer-Tropsch derived base oil, and wherein the lubricating composition has a kinematic viscosity at 100° C. (according to ASTM D 445) of below 5.6 cSt, a Noack volatility (according to ASTM D 5800) of below 15 wt. %, and a high temperature, high shear viscosity ("HTHS"; according to ASTM D 4683) of below 2.0 cP.

2. The lubricating composition according to claim 1 wherein the lubricating composition has a dynamic viscosity at −35° C. (according to ASTM D 5293) of below 6200 cP.

3. The lubricating composition according to claim 1 wherein the lubricating composition has a Noack volatility (according to ASTM D 5800) of below 14 wt. %.

4. The lubricating composition according to claim 1 wherein the base oil contains more than 90 wt. %, Fischer-Tropsch derived base oil.

5. The lubricating composition according to claim 1 wherein the lubricating composition contains less than 1.0 wt. % of a Viscosity Index improver concentrate, based on the total weight of the lubricating composition.

6. The lubricating composition according to claim 1 wherein the lubricating composition contains at least 9.0 wt. % of an additive package comprising an anti-wear additive, a metal detergent, an ashless dispersant and an anti-oxidant.

7. The lubricating composition according to claim 1 wherein the base oil has a kinematic viscosity at 100° C. of between 3.5 and 4.5 cSt.

8. The lubricating composition according to claim 1 wherein the lubricating composition has a mini rotary viscometer (MRV) value at −40° C. (according to ASTM D 4684) of below 60,000 cP.

9. The lubricating composition according to claim 1 wherein the lubricating composition has a dynamic viscosity at −35° C. (according to ASTM D 5293) of below 5000 cP.

10. The lubricating composition according to claim 1 wherein the lubricating composition has a dynamic viscosity at −35° C. (according to ASTM D 5293) of below 4000 cP.

11. The lubricating composition according to claim 1 wherein the lubricating composition has a high temperature, high shear viscosity ("HTHS"; according to ASTM D 4683) of below 1.9 cP.

12. The lubricating composition according to claim 1 wherein the base oil has a kinematic viscosity at 100° C. of between 3.5 and 5.6 cSt.

13. A method of lubrication comprising:

supplying a lubricating composition to an engine, wherein the lubricating composition comprises a base oil and one or more additives, wherein the base oil comprises more than 80 wt. % of a Fischer-Tropsch derived base oil, and wherein the lubricating composition has a kinematic viscosity at 100° C. (according to ASTM D 445) of below 5.6 cSt, a Noack volatility (according to ASTM D 5800) of below 15 wt. %, and a high temperature, high shear viscosity ("HTHS"; according to ASTM D 4683) of below 2.0 cP.

14. The method according to claim 13 wherein the composition has a high temperature, high shear viscosity ("HTHS"; according to ASTM D 4683) of below 1.9 cP.

15. The method according to claim 13 wherein the lubricating composition has a Noack volatility (according to ASTM D 5800) of below 14 wt. %.

16. The method according to claim 13 wherein the base oil contains more than 90 wt. %, Fischer-Tropsch derived base oil.

17. The method according to claim 13 wherein the lubricating composition has a dynamic viscosity at −35° C. (according to ASTM D 5293) of below 6200 cP.

18. The method according to claim 13 wherein the lubricating composition contains less than 1.0 wt. % of a Viscosity Index improver concentrate, based on the total weight of the lubricating composition.

19. The method according to claim 13 wherein the lubricating composition contains at least 9.0 wt.% of an additive package comprising an anti-wear additive, a metal detergent, an ashless dispersant and an anti-oxidant.

* * * * *